US006481715B1

(12) United States Patent
Callan

(10) Patent No.: US 6,481,715 B1
(45) Date of Patent: Nov. 19, 2002

(54) GAME

(76) Inventor: Edward William Callan, 4853 Ruette De Mer, San Diego, CA (US) 92130

( * ) Notice: Subject to any disclaimer, the term of this patent is extended or adjusted under 35 U.S.C. 154(b) by 5 days.

(21) Appl. No.: 09/839,392

(22) Filed: Apr. 20, 2001

Related U.S. Application Data

(62) Division of application No. 09/375,302, filed on Aug. 16, 1999, now Pat. No. 6,220,595.

(51) Int. Cl.[7] ..... A63F 9/24

(52) U.S. Cl. ..... 273/237; 463/10

(58) Field of Search ..... 463/1, 9, 10, 11, 463/16, 23, 21, 30, 36; 273/236–291; 434/128

(56) References Cited

U.S. PATENT DOCUMENTS

| | | | |
|---|---|---|---|
| 4,173,347 | A | 11/1979 | Field, II |
| 4,299,391 | A | 11/1981 | Silver |
| 5,188,369 | A | 2/1993 | Loewenton |
| 5,494,295 | A | 2/1996 | Potter et al. |
| 5,657,988 | A | 8/1997 | Kavounas |
| 5,855,372 | A | 1/1999 | Thiemann |

OTHER PUBLICATIONS

RISK Rules, 1980, "AttacKing", 6 pages.

*Primary Examiner*—Mark Sager
(74) *Attorney, Agent, or Firm*—Edward W. Callan

(57) ABSTRACT

In a game in which a plurality of players manage playing pieces in accordance with a set of rules, the rules provide for movement of movable playing pieces over spaces on a game board and for acquisition of property-type playing pieces from another player incident to a confrontation that occurs upon movement of one player's movable playing piece onto a space occupied by another player's movable playing piece. The outcome of the confrontation is determined by chance by using a random-output device, such as dice, or a random-output routine executed by a computer. The outcome of a turn involves an element of chance, as determined by a random-output device, and indicates either a number of spaces for movement of a movable playing piece, or that the player taking the turn has a choice of changing a variable rule that currently is not most favorable to such player so that such variable rule becomes more favorable to such player. The variable rules designate (a) odds by which one player is favored over another in determining the output of a confrontation, (b) which player is favored over another with regard to ease of movement over the game board, and (c) different values for different species of property-type playing pieces. When a player changes one variable rule to become more favorable to such player, another variable rule may change automatically to become less favorable to such player.

20 Claims, 5 Drawing Sheets

PROPERTY

+
*
23
TURN
UNIT VALUE
20
30
10
22
56a
PLAYER A
42
MOVEMENT
25a
XY
24a
SCORE
0
56b
PLAYER B
MOVEMENT
25b
12
14
16
SCORE
240
25b
24b
56c
PLAYER C
MOVEMENT
25c
X
26
12
14
16
SCORE
480
24c

GAME

CROSS REFERENCE TO RELATED APPLICATION

This is a division of application Ser. No. 09/375,302, filed Aug. 16, 1999, to be issued as U.S. Pat. No. 6,220,595 on Apr. 24, 2001.

BACKGROUND OF THE INVENTION

The present invention generally pertains to games and is particularly directed to games in which a plurality of players manage playing pieces in accordance with a set of rules.

In various games there are rules involving movement of playing pieces on a game board and additional rules for resolving confrontations that occur upon movement of a playing piece of a first player to a space on the game board occupied by a playing piece of a second player. Examples of rules for resolving confrontations that occur when the playing piece of the first player is moved to the space occupied by the playing piece of the second player are rules that cause the second player's playing piece to be either acquired by the first player, removed from play, or moved to a different space on the game board. In some games the movement of the playing pieces on the game board involves an element of chance. Also, some games, such as poker, include rules involving acquisition of property-type playing pieces, such as poker chips, by one player from another player in accordance with an element of chance. Typically, the element of chance involves using such random-output apparatus as dice, cards or a spinable-pointer-and-dial apparatus.

In addition to being embodied in such apparatus as a game board and playing pieces, games are also embodied in computer readable storage media for use with a computer, wherein a computer readable storage medium programs the computer for controlling a game displayed on a computer monitor during which a plurality of players manage playing pieces in accordance with a set of rules.

SUMMARY OF THE INVENTION

The present invention provides a computer readable storage medium for use with a computer, wherein the computer readable storage medium programs the computer for controlling a game displayed on a computer monitor during which a plurality of players manage displayed playing pieces in accordance with a set of rules, including a first variable rule that is more favorable to a first player than to a second player at least once during the course of the game; a second variable rule that is more favorable to the second player than to some other player when the first variable rule is more favorable to the first player than to the second player and becomes more favorable to said some other player than to the second player whenever the second player changes the first variable rule to become more favorable to the second player; and a change-enabling rule that enables the second player to change the first variable rule upon occurrence of a predetermined condition during the course of the game so that the first variable rule becomes more favorable to the second player. In another aspect, the present invention provides a computer readable storage medium for use with a computer, wherein the computer readable storage medium programs the computer for controlling a game displayed on a computer monitor during which a plurality of players manage displayed playing pieces in accordance with a set of rules, including a first rule involving movement of the playing pieces on a game board; and a second rule for resolving a confrontation that occurs upon movement of a playing piece of a first player to a space on the game board occupied by a playing piece of a second player; wherein the second rule involves an element of chance for resolving said confrontation; and wherein the computer readable storage medium also programs the computer for executing a random-output routine to determine the output of said confrontation.

In still another aspect, the present invention provides a computer readable storage medium for use with a computer, wherein the computer readable storage medium programs the computer for controlling a game displayed on a computer monitor during which a plurality of players take turns managing displayed playing pieces in accordance with a set of rules, including a first rule involving movement of the playing pieces on a game board; a second rule for resolving a confrontation that occurs upon movement of a playing piece of a first player to a space on the game board occupied by a playing piece of a second player; and at least one variable rule that from time to time favors one player over another player in at least one aspect of the game; wherein the outcome of a turn involves an element of chance and indicates either a number of spaces for movement of a said playing piece, or that the player taking the turn has a choice of changing a said variable rule that currently is not most favorable to such player so that such variable rule becomes more favorable to such player.

Additional features of the present invention are described with reference to the detailed description of the preferred embodiments.

DETAILED DESCRIPTION

A preferred embodiment of a game according to the present invention is embodied in a computer readable storage medium for use with a computer, wherein the computer readable storage medium programs the computer for controlling a game displayed on a computer monitor during which a plurality of players manage playing pieces in accordance with a set of rules.

Figure 1:
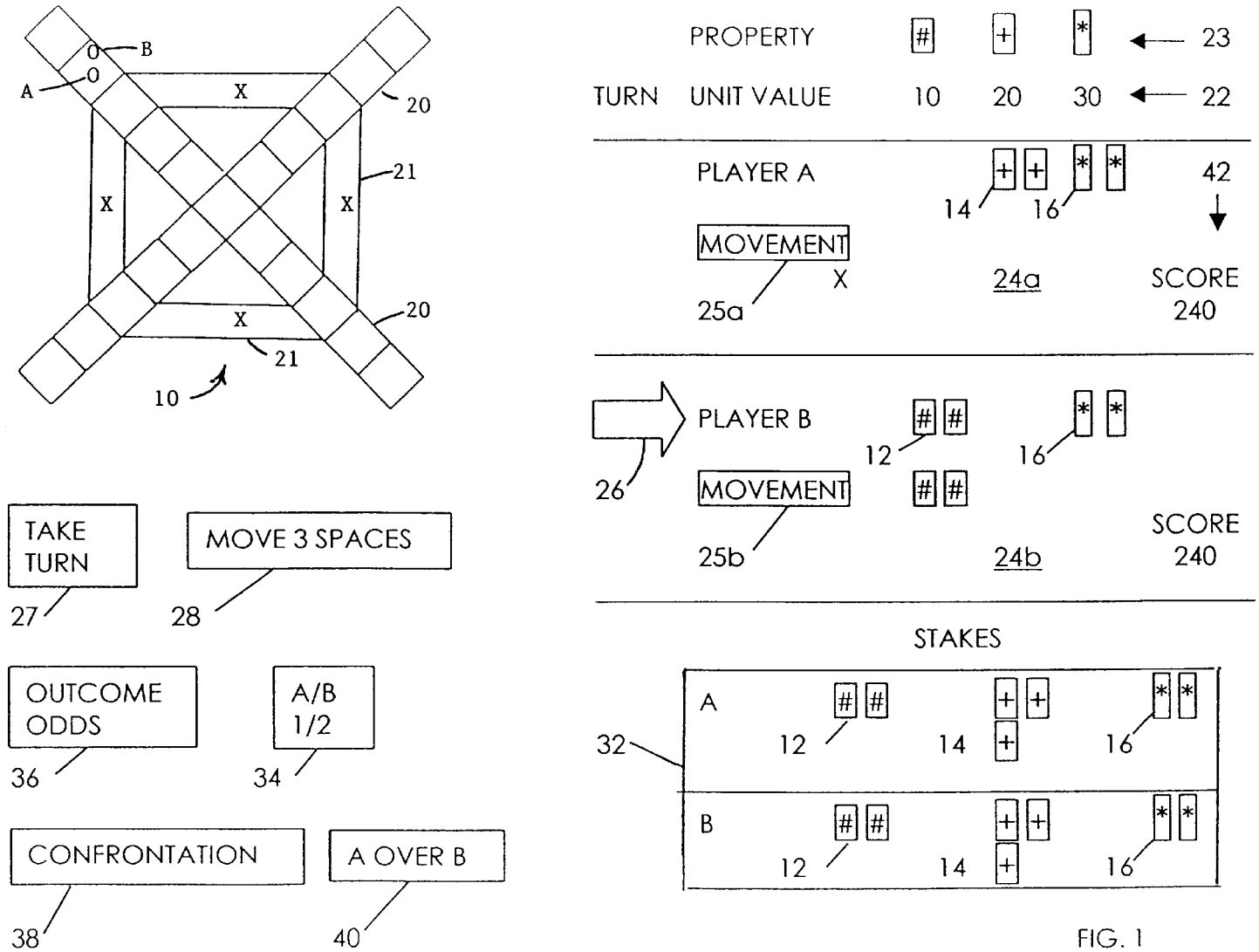
FIG. 1 shows a computer monitor display of a preferred embodiment of a game according to the present invention for two players.

In one preferred computer-controlled embodiment, as shown in FIG. 1 for a two-player version of the game, the monitor displays a game board 10, movable playing pieces A, B and a plurality of different species of property-type playing pieces 12, 14, 16 respectively distinguished by symbols #, + and *. In alternative embodiments the movable playing pieces A, B are distinguished by different shapes and/or colors rather than by letter designations; and the different species of the property-type playing pieces 12, 14, 16 are distinguished by different shapes and/or colors rather than by, or in addition to, symbol designations. The monitor also displays each of the property-type playing pieces 12, 14, 16 possessed by each player, the scoring of the game as the game progresses, aspects of the movement rules for each player, the odds for the outcome of a confrontation between the two players, the stakes of the confrontation, and the outcome of the confrontation.

In this preferred embodiment, the computer is a personal computer that is either IBM or Macintosh compatible and play of the game is controlled by use of a computer mouse. The monitor further displays icons and/or legends for use in executing a playing turn and for effecting changes in variable rules pertaining to designation of (a) the unit values of the property-type playing pieces 12, 14, 16, (b) the movement rules for each player, and (c) the odds for the outcome of a confrontation between the two players.

The game board 10 displays a first set of tracks 20 defined by rectangular spaces and a second set of tracks 21 defined by intermediately disposed spaces that are distinguished in the drawing by containing a symbol "X". In the preferred embodiment, the first set of tracks 20 is distinguished from the second set of tracks 21 by use of different colors. The movable playing pieces A, B are moved along the first and second sets of tracks 20, 21. The second set of tracks 21 intersect with the first set of tracks 20 to provide a plurality of short cuts for movement of the movable playing pieces A, B between different given pairs of spaces in the first set of tracks 20. The rules for this two-player version of the game and their implementation in this computer-controlled embodiment are as follows:

Rule 1. The object of the game is to possess the highest total value of property-type playing pieces.

Rule 2. There are different species of the property-type playing pieces having respectively different unit values. The designation of the relative unit values of the different species of the property-type playing pieces at any given time during the course of the game is a variable rule that can be changed pursuant to execution of Rules 17 and 18.

Implementation of Rule 2: The current unit values of the different species of the property-type playing pieces 12, 14, 16 are displayed by the monitor in row 22 adjacent icons bearing their respective symbols #, +and * in row 23. In the monitor display shown in FIG. 1, the current unit value of the property-type playing pieces 12 bearing the symbol # is 10; the current unit value of the property-type playing pieces 14 bearing the symbol +is 20; and the current unit value of the property-type playing pieces 16 bearing the symbol * is 30.

Rule 3. Each player has one movable playing piece.

Rule 4. At the beginning of the game each player possesses the same number of each of the different species of the property-type playing pieces, the movable playing pieces of the two players are positioned at opposite ends of one of the tracks of the first set of tracks, the designation aspect of Rule 8 favors player A and the designation aspect of Rule 15 favors player B. A designation of which player is player A and which player is player B is determined by agreement between the players, or by chance, such as by flipping a coin or drawing cards.

Implementation of Rule 4: The property-type playing pieces 12, 14, 16 respectively possessed by each player are displayed in the respective property portions 24*a*, 24*b* of the monitor display.

Rule 5. The game ends either (a) when one player has acquired all of the property-type playing pieces; (b) at the end of a predetermined period, such as thirty minutes; or (c) when each player has had a predetermined number of playing turns, such as fifty, with the predetermined period or the predetermined number of turns being agreed upon by the players before the game commences.

Implementation of Rule 5: The game may also end (d) at a time randomly determined by a routine executed by the computer after the game has been played for a predetermined time or for a predetermined number of turns.

Rule 6. One player can acquire property-type playing pieces of another player as an outcome of a confrontation with the other player, as further discussed in Rules 12 through 15.

Rule 7. Each player can move his/her respective movable playing piece on the first set of tracks.

Implementation of Rule 7: The computer mouse is used to drag the movable playing pieces A, B over the first set of tracks 20.

Rule 8. One player is favored over the other by being enabled to move his/her movable playing piece on the second set of tracks, provided that such movement cannot end with the movable playing piece on a space of the second set of tracks. The designation of a player to be so favored is a variable rule that can be changed pursuant to execution of Rules 16 and 18.

Implementation of Rule 8: The designation aspect of this movement rule is displayed as shown in FIG. 1 by indicating an X symbol for player A adjacent a movement legend 25*a* for player A, whereas no symbol is indicated adjacent the movement legend 25*b* for player B, thereby indicating that player A can move the movable playing piece A on the second set of tracks 21 and that player B cannot move the movable playing piece B on the second set of tracks 21. The computer mouse is also used to drag the movable playing pieces over the second set of tracks 21.

Rule 9. The players take turns playing, with player A taking the first turn, and player B taking the second turn.

Implementation of Rule 9: The player whose turn it is to play next is indicated by a turn-indication arrow 26 on the monitor display. A player executes a turn by clicking a TAKE TURN legend 27 on the monitor display.

Rule 10. The outcome of a turn involves an element of chance, as determined by random-output means, and indicates either a number of spaces for movement, or that the player taking the turn has a choice of changing a variable rule that currently is not most favorable to such player so that such variable rule becomes more favorable to such player.

Figure 2:
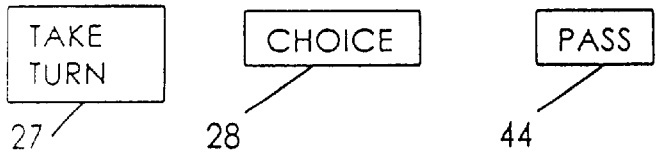
FIG. 2 shows a different outcome of a turn from that shown in the outcome-of- turn portion of the game display of FIG. 1.

Implementation of Rule 10: The computer randomly provides one of a number of predetermined outputs by executing an outcome-of-turn routine in response to a player executing a turn. An outcome-of-turn display 28 on the monitor indicates either a number of spaces for movement, such as MOVE 3 SPACES, as shown in FIG. 1, or the word CHOICE, as shown in FIG. 2. Upon indicating a number of spaces for movement, the outcome-of-turn display 28 also indicates whether the player taking the turn is enabled to move his/her movable playing piece A, B on the second set of tracks 21 by also displaying the X symbol when such player is so enabled (not shown in FIG. 1). Further play pursuant to a choice outcome-of-turn indication is discussed below in relation to Rules 16–18.

Rule 11. Each player can move his/her respective movable playing piece not more than the number of spaces indicated by the outcome of the turn.

Rule 12. A confrontation between players occurs when one player moves his/her movable playing piece onto a space Occupied by a movable playing piece of another player and such confrontation is completed as a part of the same turn.

Rule 13. A confrontation involves the one player who moves onto the space occupied by the other player wagering a number of his/her property-type playing pieces against a number of property-type playing pieces possessed by the other player having a total value not greater than the total value of the property-type playing pieces wagered by the one player. The one player selects the property-type playing pieces of both players that he/she desires to place at stake in the confrontation.

Implementation of Rule 13: The one player uses the computer mouse to (a) drag selected ones of his/her own property-type playing pieces 12, 14, 16 to the "A" segment of the stakes portion 32 of the display adjacent the legend "STAKES"; and then (b) uses computer mouse to select and drag to the "B" segment of the stakes portion 32 of the display a quantity of the other player's property-type playing pieces 12, 14, 16 that have a total value not greater than the total value of the selected property-type playing pieces 12, 14, 16 of the one player. The stakes portion 32 of the display in FIG. 1 shows the property-type playing pieces 12, 14, 16 selected by player B as wager stakes in a confrontation between players B and A pursuant to player B having moved his/her movable playing piece B onto a space in the first set of tracks 20 occupied by player A, as shown in FIG. 1.

Rule 14. The number of property-type playing pieces of the one player that can wagered upon the first confrontation of the game is limited to be not more than a given number, such as one-third or one-half (as agreed upon by the players before the beginning of the game) of the total number of the property-type playing pieces possessed by the one player at the beginning of the game, in order to prevent the one player from ending the game too early by placing all or most of the property-type playing pieces at stake upon the first confrontation of the game.

Rule 15. The outcome of each confrontation involves an element of chance that is more favorable to one player than to the other player in accordance with predetermined odds. The designation of a player to be favored by the confrontation odds is a variable rule that can be changed pursuant to execution of Rules 16 and 18.

Figure 3:
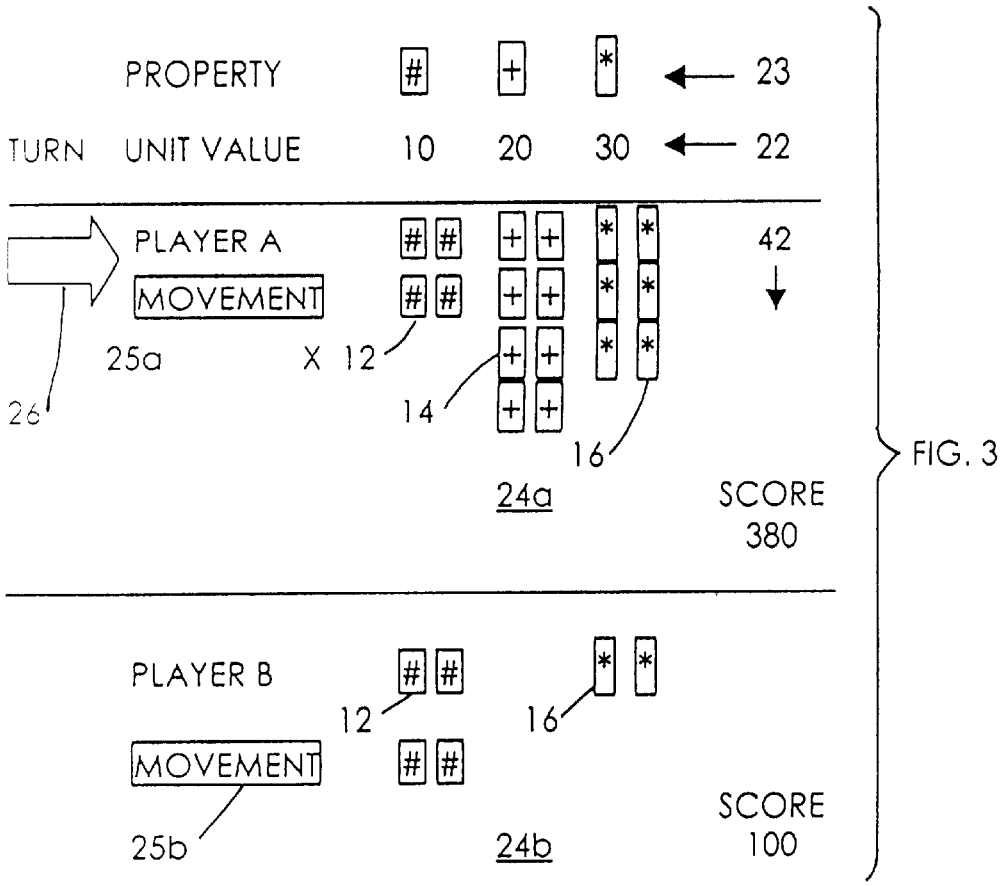
FIG. 3 shows a change in the scoring portion of the game display from that shown in FIG. 1 in accordance with the outcome of the confrontation illustrated in FIG. 1.

Implementation of Rule 15: An outcome-odds display 34 on the monitor to the right of the OUTCOME ODDS legend 36 indicates the current odds for the outcome of a confrontation between players A and B. In the monitor display shown in FIG. 1, the current odds indicated by the outcome-odds display 34 are "A/B ½", thereby indicating odds of two-to-one in favor of player B. The outcome of the confrontation is determined by an outcome-of-confrontation routine executed by the computer in accordance with the current predetermined odds. The outcome-of-confrontation routine is executed by the computer in response to a player clicking a CONFRONTATION legend 38 on the monitor display. A confrontation-outcome display 40 on the monitor to the right of the CONFRONTATION legend 38 indicates the outcome of the confrontation. In the monitor display shown in FIG. 1, the outcome indicated by the confrontation-outcome display 40 is "A OVER B", thereby indicating that player A prevailed over player B. In response to the outcome of the confrontation having been determined by execution of the outcome-of-confrontation routine, the computer executes a confrontation-output-implementation routine pursuant to which the property-type playing pieces 12, 14, 16 that were at stake during the confrontation are moved from the stakes portion 32 of the display to the property portion 24*a* of the display showing the property-type playing pieces 12, 14, 16 possessed by the player (A) whom prevailed in the confrontation, and the current scores of the players are displayed in the portions of the right-hand column 42 of the monitor display adjacent the respective property portions 24*a*, 24*b* of the display, as shown in FIG. 3, which shows new scores in relation to those shown in FIG. 1 and that the property portion 24*a* of the display for the prevailing player has been adjusted by addition thereto of the stakes of the wager shown in FIG. 1. The scores shown in FIG. 1 take into account the property-type playing pieces 12, 14, 16 possessed by each player that have been placed at stake by being dragged from the respective property portions 24*a*, 24*b* to the stakes portion 32.

Rule 16. A player can be favored at any given time by the designation aspect of only one of Rule 8 and Rule 15, such that when a player chooses to change the designation aspect of one of these two variable rules that currently is not favorable to such player so that the designation aspect of such variable rule becomes favorable to such player, the designation aspect of the other of these two variable rules that currently is favorable to such player changes to become unfavorable to such player.

Rule 17. A change in the relative unit values of the different species of the property-type playing pieces involves an interchange in unit values between two different species of property-type playing pieces.

Rule 18. The player exercising a choice selects the variable rule for which the designation aspect is to be changed.

Figure 4:
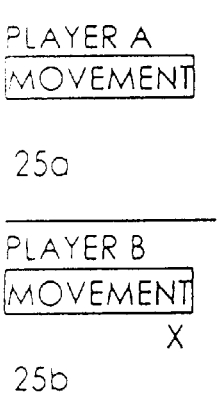
FIG. 4 shows a change in the movement rules portion of the game display in relation to the display thereof in FIG. 1.
Figure 5:
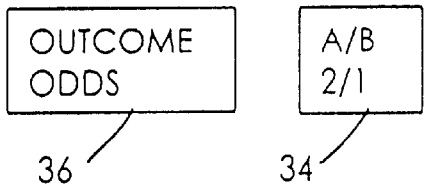
FIG. 5 shows a change in the confrontation odds portion of the game display in relation to the display thereof in FIG. 1.

Implementation of Rule 18 in accordance with Rule 16; A player selects changes in the designation aspects of variable Rules 8 and Rule 15 (which changes are necessarily interrelated in accordance with Rule 16) by clicking the OUTCOME ODDS legend 36, whereupon the computer displays a recitation of the selection and requests confirmation or rejection thereof by the player. When the player confirms the selection, the computer executes a routine to interchange the designations of which players are favored respectively by Rules 8 and 15, and causes the new designations to be displayed, as shown in FIGS. 4 and 5 in comparison to FIG. 1.

Implementation of Rule 18 in accordance with Rule 17: A player selects a change in the designation aspect of Rule 2 by selecting two of the different species of property-type playing pieces (12, 16 for example) whose unit values are to be interchanged by successively clicking the icons # and * in row 23 that respectively indicate the two selected species of property-type playing pieces 12, 16, whereupon the computer displays a recitation of the selection and requests confirmation or rejection thereof by the player.

Figure 6A:
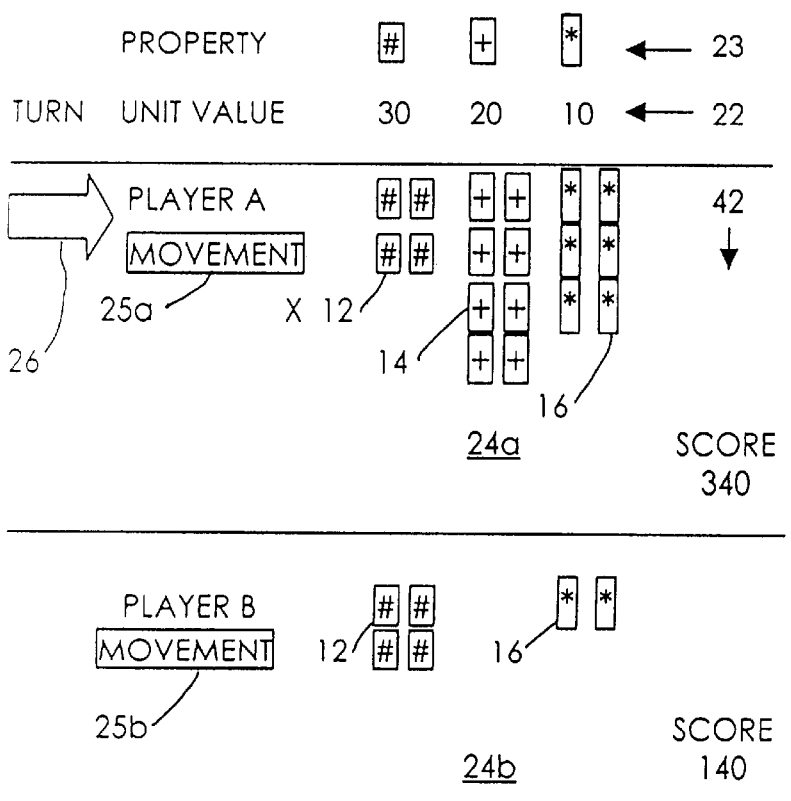
FIG. 6A shows changes in the unit values of the different species of property-type playing pieces and in the scoring portions of the game display in relation to the display thereof shown in FIG. 3, in accordance with one variable rule for changing such unit values.

When the player confirms the selection, the computer executes a routine to compute and display new scores for the respective players in accordance with such change, and to display the new unit values, as shown in FIG. 6A in comparison to FIG. 3.

When the player rejects a displayed recitation of the selection, the player must repeat whichever of the above selection procedures is applicable for a different selection.

Modified implementation of Rule 18: Choice selections are made from menus displayed on the monitor by the computer upon the player being provided with a choice to change the designation aspects of Rules 2, 8 and 15.

Rule 19. A player having a choice to change a variable rule may decline to do so.

Implementation of Rule 19: A player declines to exercise a choice to change a variable rule by clicking the PASS legend 44 shown in FIG. 2, whereupon the computer repositions the display of the turn-indication arrow 26 to indicate that it is the other player's turn.

In alternative two-player versions of the computer-controlled embodiment of the game, one or more of the foregoing rules may be replaced and/or modified by the following respectively numbered alternative rules:

Rule 2a. There is only one species of property-type playing pieces.

Rule 3a. Each player has two movable playing pieces.

Rule 4a. When each player has two moveable playing pieces, at the beginning of the game the movable playing pieces of one player are positioned at opposite ends of one track of the first set of tracks and the movable playing pieces of the other player are positioned at opposite ends of another track of the first set of tracks.

Rule 4b. At the beginning of the game, no player is favored by either Rule 8 or Rule 15.

Rule 7a. Each player can move his/her respective movable playing piece(s) on all of the sets of tracks.

Rule 8a. Movement of a movable playing piece on other than the first set of tracks can end with the movable playing piece on any of the sets of tracks.

Rule 8b. One player is favored by having a higher probability of being granted a higher number of movement spaces than another player pursuant to an outcome of a turn.

The designation of which player(s) is so favored is a variable rule that can be changed pursuant to execution of Rules 16, 16a and 18.

Implementation of Rule 8b: The monitor display indicates which player is favored by Rule 8b. The computer executes an outcome-of-turn routine for the designated player that has a higher probability of granting a higher number of movement spaces than does the outcome-of-turn routine executed by the computer for the other player.

Rule 8c. No player is favored over any other player by having a higher probability of being granted a higher number of movement spaces than another player.

Rule 10a. One or more spaces on the game board indicate that the player moving a movable playing piece onto such a space has a choice of changing a variable rule that currently is not most favorable to such player so such variable rule becomes more favorable to such player.

Rule 11a. When each player has more than one movable playing piece each player can move his/her respective playing pieces a combined number of spaces not more than the number of spaces indicated by the outcome of the turn.

Rule 11b. When each player has more than one movable playing piece each player can move only one of his/her respective playing pieces a number of spaces not more than the number of spaces indicated by the outcome of the turn.

Rule 11c. Each player can move only one of his/her respective playing piece(s) only the exact number of spaces indicated by the outcome of the turn.

Rule 14a. The number of property-type playing pieces of either player that can be selected as the stakes during any single confrontation is unlimited.

Rule 15a. The outcome of each confrontation involves an element of chance that is no more favorable to one player than to another player.

Rule 16a. A player can be favored at any given time by either or both of Rule 8/8b and Rule 15.

Rule 17a. A change in the relative values of the different species of property-type playing pieces may, if the player making the change so chooses, involve an interchange of unit values between more than two different species.

Implementation of Rule 17a: For three different species of property-type playing pieces, if the change results in the species previously having the lowest unit value attaining the highest unit value, the species previously having the highest unit value assumes the second-highest unit value; and if the change results in the species previously having the second-highest unit value attaining the highest unit value, the species previously having the highest unit value assumes the lowest unit value.

Implementation of Rule 18 in accordance with Rule 16a: A player selects a change in the designation aspect of variable Rule 8/8b by clicking his/her respective MOVEMENT legend 46, whereupon the computer displays a recitation of the selection and requests confirmation or rejection thereof by the player. When the player confirms the selection, the computer executes a routine to designate such player to be favored by Rule 8/8b, and causes the new designation to be displayed, as shown in FIG. 4 in comparison to FIG. 1. A player selects a change in the designation aspect of variable Rule 15 by clicking the OUTCOME ODDS legend 36, whereupon the computer displays a recitation of the selection and requests confirmation or rejection thereof by the player. When the player confirms the selection, the computer executes a routine to designate such player to be favored by Rule 15, and causes the new designation to be displayed, as shown in FIG. 5 in comparison to FIG. 1.

Figure 6B:
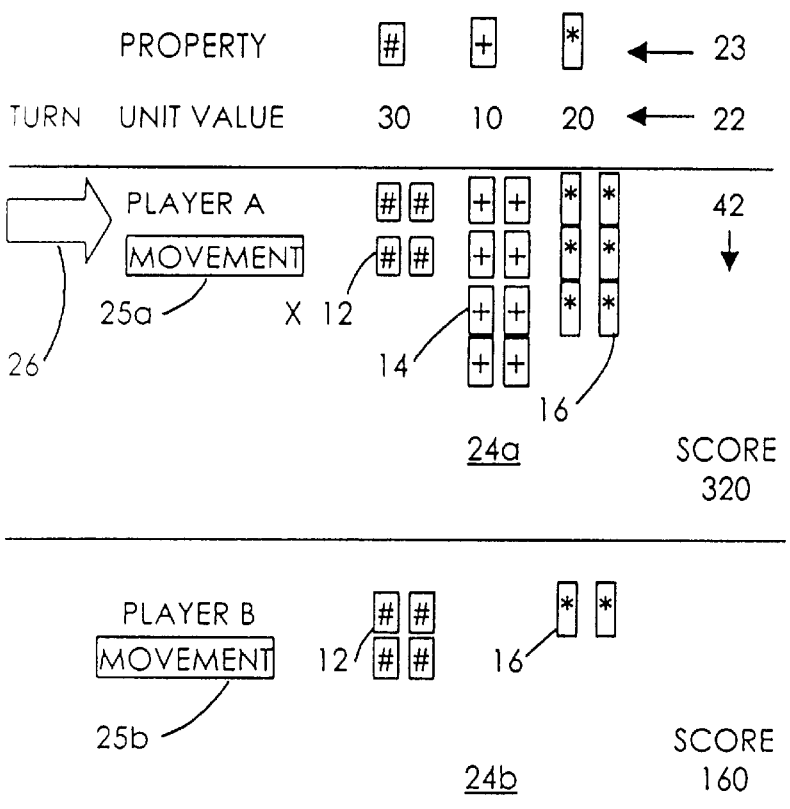
FIG. 6B shows changes in the unit values of the different species of property-type playing pieces and in the scoring portions of the game display in relation to the display thereof shown in FIG. 3, in accordance with an alternative variable rule for changing such unit values.

Implementation of Rule 18 in accordance with Rule 17a: A player selects a change in the designation aspect of Rule 2 by clicking the one of the icons #, +, * in row 23 that indicates the species of property-type playing pieces 12, 14, 16 that is selected to attain the highest unit value, whereupon the computer displays a recitation of the selection and requests confirmation or rejection thereof by the player. When the player confirms the selection, the computer executes a routine to compute and display new scores for the respective players in accordance with such change, and to display the new unit values, as shown in FIG. 6B in comparison to FIG. 3.

Further implementation of the foregoing alternative rules is the same as the implementation of the first recited set of rules except when stated otherwise and/or inconsistent therewith.

Figure 7:
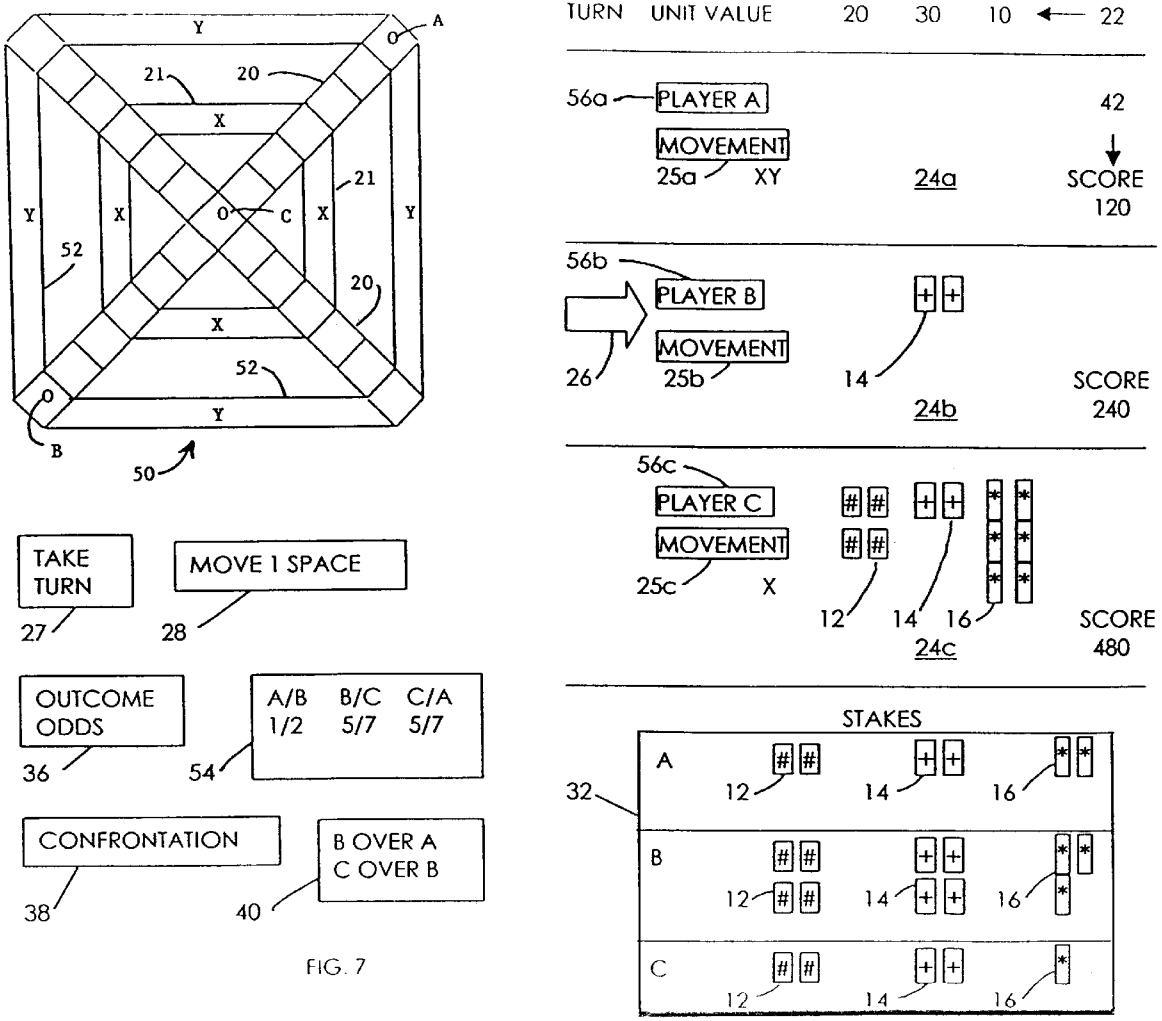
FIG. 7 shows a computer monitor display of a preferred embodiment of a game according to the present invention for three players.

In another preferred computer-controlled embodiment, as shown in FIG. 7 for a three-player version of the game, the monitor displays a game board 50, movable playing pieces A, B, C and a plurality of different species of property-type playing pieces 12, 14, 16 respectively distinguished by symbols #, + and *.

The game board 50 displays a first set of tracks 20 defined by rectangular spaces, a second set of tracks 21 defined by intermediately disposed spaces that are distinguished in the drawing by containing a symbol "X" and a third set of peripherally disposed tracks 52 that are distinguished in the drawing by containing a symbol "Y". In the preferred embodiment, the first set of tracks 20, the second set of tracks 21 and the third set of tracks 52 are distinguished from each other by use of different colors. The movable playing pieces A, B, C are moved along the first, second and third sets of tracks 20, 21, 52. The second set of tracks 21 and the third set of tracks 52 respectively intersect with the first set of tracks 20 to provide a plurality of short cuts for movement of the movable playing pieces A, B, C between different given pairs of spaces in the first set of tracks 20.

Except for those aspects of the monitor display that pertain to a three-player version of the game, the monitor display is the same as the monitor display for the two-layer version of the game described above.

The rules and alternative rules of three-player versions of the game and their implementation in this computer-controlled embodiment are the same as for the two-player versions of the game described above, except when necessarily modified by the following rules and/or the following implementation thereof:

Rule 4*. At the beginning of the game each player possesses the same number of each of the different species of the property-type playing pieces, the movable playing pieces of players A and B are positioned at opposite ends of one of the tracks of the first set of tracks, the movable player piece of player C is positioned in a space of the first set of tracks at the center thereof, the designation aspect of Rule 8* favors player A over both players B and C and favors player C over player B, the designation aspect of Rule 15 favors player B over both players A and C and favors player C over player A. A designation of which player is player A, which player is player B and which player is player C is determined by agreement between the players or by chance, such as by flipping a coin or drawing cards.

Rule 5*. When a given player no longer possesses any property-type playing pieces, the given player is eliminated from the game.

Rule 8*. One player is favored over both other players by being enabled to move his/her movable playing piece on both the second set of tracks and the third set of tracks, provided that such movement cannot end with the movable playing piece on a space of either the second set of tracks or the third set of tracks. A second player who is disfavored with respect to the one player by not being enabled to move his/her movable playing piece on the third set of tracks is favored with respect to the third player by being enabled to move his/her movable playing piece on the second set of tracks. The designation of which players are so favored is a variable rule that can be changed pursuant to execution of Rules 16* and 18.

Implementation of Rule 8*: The designation aspect of this movement rule is displayed as shown in FIG. 7 by indicating both an X symbol and a Y symbol for player A; the X symbol for player C, and no symbol for player B, thereby indicating that player A can move the movable playing piece A on the second set of tracks 21 and the third set of tracks 52, that player C can move the movable playing piece C on the second set of tracks 21, but not the third set of tracks 52 and that player B cannot move the movable playing piece B on either the second set of tracks 21 or the third set of tracks 52. The computer mouse is also used to drag the movable playing pieces over the second set of tracks 21 and the third set of tracks 52.

Implementation of Rule 10 in accordance with Rule 8*: Upon indicating a number of spaces for movement, the outcome-of-turn display 28 also indicates on which, if any, of the second and third sets of tracks 21, 52 the player taking the turn is enabled to move his/her movable playing piece A, B, C by displaying either no symbols, only one of the X and Y symbols, or both of the X and Y symbols.

Rule 13*. A confrontation involves the one player who moves onto a space occupied by one or more of the other players wagering a number of his/her property-type playing pieces against a number of property-type playing pieces possessed by the other player or players having a total value not greater than the total value of the property-type playing pieces wagered by the one player. The one player selects the property-type playing pieces of each player that he/she desires to place at stake in the confrontation.

Implementation of Rule 13*: The stakes portion 32 of the display in FIG. 7 shows the property-type playing pieces 12, 14, 16 selected by player B as wager stakes in simultaneous confrontations between players B and A and between players B and C pursuant to player B having moved his/her movable playing piece B onto a space in the first set of tracks 20 occupied by both players A and C (not shown).

Figure 8:
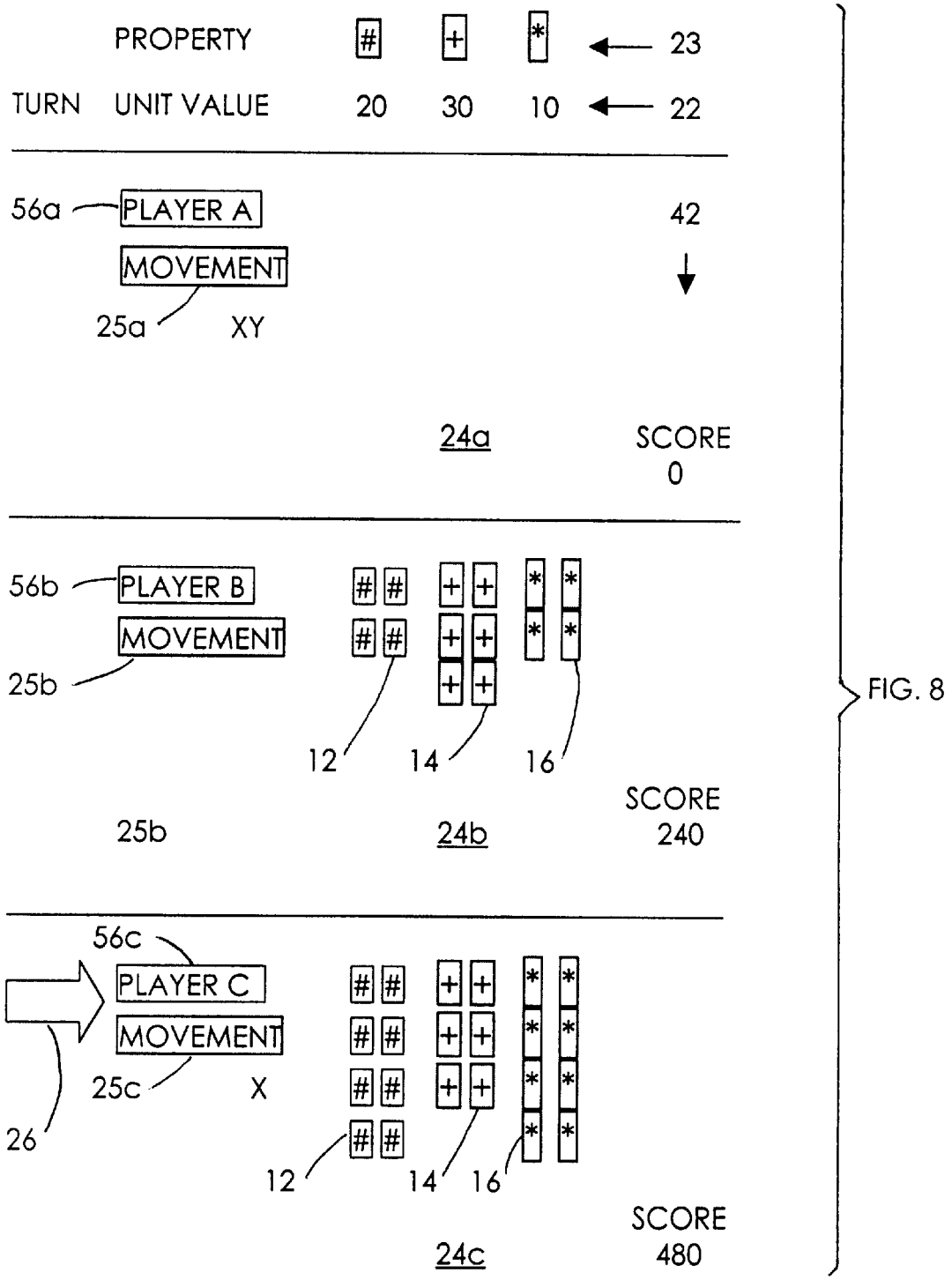
FIG. 8 shows changes in the unit values of the different species of property-type playing pieces and in the scoring portions of the game display in relation to the display thereof shown in FIG. 7.

Implementation of Rule 15 in accordance with Rule 13*: An outcome-odds display 54 on the monitor to the right of the OUTCOME ODDS legend 36 indicates the current odds for the respective outcomes of confrontations between players A and B, between players A and C and between players B and C. In the monitor display shown in FIG. 7, the current odds indicated by the outcome-odds display 54 are "A/B ½" thereby indicating odds of two-to-one in favor of player B over player A; "B/C 5/7" thereby indicating odds of seven-to-five in favor of player C over player B; and "C/A 5/7" thereby indicating odds of seven-to-five in favor of player A over player C. In the monitor display shown in FIG. 7, the outcome indicated by the confrontation-outcome display 40 is "B OVER A" thereby indicating that player B prevailed over player A, and "C OVER B" thereby indicating that player C prevailed over player B. In response to the outcome of these confrontations having been determined by execution of the outcome-of-confrontation routine, the computer executes a confrontation-output-implementation routine pursuant to which the property-type playing pieces 12, 14, 16 that were at stake during the confrontation are moved from the stakes portion 32 of the display to the respective property portions 24*b*, 24*c* of the display for the different players (B, C) that prevailed in these confrontations, and the current scores of all of the players are displayed in the portions of the right-hand column 42 of the monitor display adjacent the respective property portions 24*a*, 24*b*, 24*c* of the display for the different players, as shown in FIG. 8, which shows new scores in relation to those shown in FIG. 7 and that the property portions 24*b*, 24*c* of the display showing the property-type playing pieces 12, 14, 16 possessed by players B and C have been adjusted respectively by addition thereto of the stakes of the wagers shown in FIG. 7 won by players B and C. Player A lost all of his/her property-type playing pieces 12, 14, 16 and was thereby eliminated from the game. The scores shown in FIG. 7 take into account the property-type playing pieces 12, 14, 16 possessed by each player that have been placed at stake by being dragged from the respective property portions 24*a*, 24*b*, 24*c* to the stakes portion 32.

Rule 16*. A player can be favored over another player at any given time by the designation aspect of only one of Rule 8*/8b* and Rule 15, such that when a player chooses to change the one of these two variable rules that currently is not favorable to such player with respect to both other players so that such variable rule becomes favorable to such player with respect to both other players, the other of these two variable rules that currently is so favorable to such player changes to become unfavorable to such other player and with respect to the third player both rules are changed so that no player is favored over another player at any time by both of Rules 8* and 15.

Implementation of Rule 16*: When player A chooses to change the designation aspect of Rule 15 from the state thereof prevailing at the beginning of the game so that the designation aspect of Rule 15 becomes more favorable to player A than to player B, the designation aspects of Rules 8* and 15 are changed so that the designation aspect of Rule 8* becomes more favorable to player B than to player A, the designation aspect of Rule 8* becomes more favorable to player C than to player A, the designation aspect of Rule 8* becomes more favorable to player B than to player C, the designation aspect of Rule 15 becomes more favorable to player C than to player B and the designation aspect of Rule 15 becomes more favorable to player A than to player C. Table I below indicates the different combinations of favorable designation aspects between the respective players A, B, C under Rules 8* and 15 that may prevail in accordance with this Rule 16* for exemplary confrontation odds of 2:1 and 7:5.

TABLE I

| COMBINATION | CONFRONTATION ODDS | | | MOVEMENT | | |
|---|---|---|---|---|---|---|
| NO. | A/B | B/C | C/A | A | B | C |
| 1 | 1:2 | 5:7 | 5:7 | XY | | X |
| 2 | 5:7 | 1:2 | 5:7 | X | XY | |
| 3 | 5:7 | 5:7 | 1:2 | | X | XY |
| 4 | 2:1 | 7:5 | 7:5 | | XY | X |
| 5 | 7:5 | 2:1 | 7:5 | X | | XY |
| 6 | 7:5 | 7:5 | 2:1 | XY | X | |

Implementation of Rule 18 in accordance with Rule 16*: A player selects a change in the designation aspect of variable Rule 8* with respect to another player with whom he/she desires to interchange degrees of favoritism under the designation aspect of Rule 8* by clicking the MOVEMENT legend 25*a*, 25*b*, 25*c* for the other player, whereupon the computer displays a recitation of the selection and requests confirmation or rejection thereof by the player. A player selects a change in variable Rule 15 with respect to another player with whom he/she desires to interchange degrees of favoritism under Rule 15 by first clicking the OUTCOME ODDS legend 36 and then clicking the PLAYER legend 56*a*, 56*b*, 56*c* for the other player, whereupon the computer displays a recitation of the selection and requests confirmation or rejection thereof by the player. When the player confirms the displayed selection, the computer executes a routine to interchange the designations of which player is favored by Rules 8* and 15 in accordance with Rule 16*, and causes the new designations to be displayed.

In alternative three-player versions of the computer-controlled embodiment of the game, one or more of the foregoing rules may be replaced and/or modified by the following respectively numbered alternative rules:

Rule 4a*. When each player has two moveable playing pieces, at the beginning of the game the movable playing pieces of a first player are positioned at opposite ends of one track of the first set of tracks, the movable playing pieces of a second player are positioned at opposite ends of another track of the first set of tracks, and both movable playing pieces of a third player are positioned in a space of the first set of tracks at the intersection thereof.

Rule 8b*. One player may be favored by having a higher probability of being granted a higher number of movement spaces than one or both of the other players pursuant to an outcome of a turn. The designation of which player(s) is so favored is a variable rule that can be changed in accordance with Rules 16*, 16a* /16b* and 18.

Rule 16a*. Upon changing a variable rule a player can be favored over both of the other players by the designation aspect of only one of Rule 2, Rule 8*/8b* and Rule 15, such that when a player chooses to change one of these three variable rules to become most favorable to such player, one or both of the other two variable rules change whenever necessary to prevent any player from being favored over both other players after the change by the designation aspects of more than one of Rules 2, 8*/8b* and 15. The designation aspect of Rule 2 favors one player over another player when the cumulative value of any of the two highest valued species possessed by the one player is higher than the cumulative value of the two highest valued species possessed by the other player. When the cumulative values of the two highest valued property-type playing pieces possessed by one player is the same as the two highest valued property-type playing pieces possessed by another player, neither player is favored over the other. When one player is favored over both other players by the designation aspect of only a given one of Rules 2, 8*/8b* and 15 before choosing to change the designation aspect of another of Rules 2, 8*/8b* and 15 and the rule chosen to be changed becomes more favorable to the one player than to both other players, the given rule that favored the one player prior to the change is changed so that the one player's relative rank for the given rule becomes the same as the one player's relative rank for the chosen rule prior to the change.

Implementation of Rule 16a*: When player A chooses to make such a change, the designation aspects of Rules 2, 8*/8b* and 15 are changed in accordance with the quantities of the different species of property-type playing pieces 12, 14, 16 then possessed by the respective players A, B, C so that no player is favored over both other players at any time by more than one of the designation aspects of Rules 2, 8*/8b* and 15.

Rule 16b*. When one player is favored over both other players by the designation aspect of only a given one of Rules 2, 8*/8b* and 15 before choosing to change the designation aspect of another of Rules 2, 8*/8b* and 15, the relative rankings of the players with respect to the designation aspects of Rules 2, 8*/8b* and 15 cannot be changed to be inconsistent with Rule 16*.

Implementation of Rule 16b*: Table II below indicates the different combinations of most-favorable aspects between the respective players A, B, C under Rules 2, 8*/8b* and 15 that may prevail in accordance with this Rule 16b*. The combination numbers correspond to those for Table I.

TABLE II

| COMBI- | MOST FAVORED PLAYER | | |
|---|---|---|---|
| NATION NO. | CONFRONTATION ODDS | MOVEMENT | UNIT VALUE |
| 1 | B | A | C |
| 2 | C | B | A |
| 3 | A | C | B |
| 4 | A | B | C |
| 5 | B | C | A |
| 6 | C | A | B |

Rule 16c*. A player can be favored over both other players at any given time by the designation aspects more than one of Rule 2, Rule 8*/8b* and Rule 15.

Further implementation of the foregoing alternative rules for the three-player versions of the computer-controlled embodiment of the game, is the same as the implementation of the above-recited sets of rules except when stated otherwise and/or inconsistent therewith.

The computer readable storage medium programs the computer to prevent the players from managing play in a manner inconsistent with the applicable rules.

The computer readable storage medium further programs the computer to cause the computer to default to the first-recited set of rules to control management of the game and to provide a default-selection routine that can be executed upon demand to modify the selection of the rules to which the computer defaults for controlling management of the game.

The computer readable storage medium programs the computer to cause the computer to store the first-recited set of rules and the alternative rules and to enable the text of such rules to be displayed and printed.

The computer readable storage medium also programs the computer to execute a set-up routine before a session of play begins, wherein menus are displayed that prompt the players to determine (a) the number of players, (b) which player is player A, which player is player B and which player, if any, is player C, (c) the relative values of the property-type playing pieces, (d) the confrontation odds, (e) the designation of which player, if any, is to be favored by Rule 8/8b/8*/8b* and/or Rule 15 at the beginning of the game, (f) the limitation, if any, of the number of property-type playing pieces that can be wagered upon the first confrontation of the game in accordance with Rule 14, (g) when the game ends in accordance with Rule 5, and (h) which, if any, of the alternative rules are to apply.

Alternative preferred embodiments of the game are embodied in tangible playing pieces, a tangible game board and a printed set of rules; and the outcome of a turn of play or a confrontation is determined by using dice, cards or a spinable-pointer-and-dial apparatus. The rules of play, including the alternative rules, are the same as described above for the computer-controlled embodiments. The game apparatus further includes (i) display cards for indicating (a) which player(s) is favored by the applicable movement rule (Rule 8, 8b, 8* or 8b*), (b) the different combinations of the predetermined odds for the outcome of a confrontation between each of the respective pairs of players and (c) the different combinations of the unit values of the different species of property-type playing pieces; (ii) variable-rule-combination cards respectively indicating the different combinations of favorable aspects between the respective players A, B, C under Rules 8* and 15 that may prevail in accordance with Rule 16*, such as shown in Table I, and the different combinations of favorable aspects between the respective players A, B, C under Rules 2, 8*/8b* and 15 that may prevail in accordance with Rule 16a* as modified by Rule 16b*, as shown in Table II, and, when two dice are used to determine the outcome of the confrontation, (iii) a confrontation-outcome card indicating which numbers favor one player over another in accordance with different predetermined odds for the outcome of a confrontation. An example of such a confrontation-output card is shown below in Table III.

TABLE III

| CONFRONTATION ODDS | FAVORITE WINS WHEN NUMBER IS | UNDERDOG WINS WHEN NUMBER IS |
|---|---|---|
| 5 TO 1 | 2–6 OR 8–12 | 7 |
| 7 TO 2 | 2–6, 8–10 OR 12 | 7 OR 11 |
| 3 TO 1 | 2–6, 8, 9, 11 OR 12 | 7 OR 10 |
| 2 TO 1 | 2–6, 9, 10 OR 11 | 7, 8 OR 12 |
| 11 TO 7 | 2–6, 9, 11 OR 12 | 7, 8 OR 10 |
| 7 TO 5 | 2–6 OR 10–12 | 7, 8 OR 9 |
| 5 TO 4 | 2–5 OR 9–12 | 6, 7 OR 8 |
| EVEN | 2, 4, 6, 8, 10 or 12 | 3, 5, 7, 9 or 11 |

One or two dice can be used to determine the outcome of a turn. When one die is used, a CHOICE option is indicated by a given one of the six different numbers such as 6. When two dice are used, a choice is indicated by any double number. All other numbers indicate the number of spaces that a player can move his/her movable player piece. When Rule 8b is applicable, a turn is taken by the favored player using two dice and the other player using one die.

Other versions of the game are adapted for play by more than three players in accordance with one or more of the features of the two-player and three-players versions of the game described above.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as. examples of the preferred embodiments described herein. Other variations are possible and the scope of the present invention should be determined not by the embodiments described herein but rather by the claims and their legal equivalents.

What is claimed is:

1. A computer readable storage medium for use with a computer, wherein the computer readable storage medium programs the computer for controlling a game displayed on a computer monitor during which a plurality of players take turns managing displayed playing pieces in accordance with a set of rules, including a first rule involving movement of the playing pieces on a game board;

a second rule for resolving a confrontation that occurs upon movement of a playing piece of a first player to a space on the game board occupied by a playing piece of a second player; and at least one variable rule that from time to time favors one player over another player in at least one aspect of the game;

wherein the outcome of a turn involves an element of chance and indicates either a number of spaces for movement of a said playing piece, or that the player taking the turn has a choice of changing a said variable rule that currently is not most favorable to such player so that such variable rule becomes more favorable to such player.

2. A computer readable storage medium according to claim 1, wherein the at least one variable rule(s) designate (a) odds by which one player is favored over another in determining the output of a confrontation, (b) which player is favored over another with regard to ease of movement over the game board, and/or (c) different values for different species of property-type playing pieces.

3. A computer readable storage medium according to claim 1, wherein the rules provide that when a player changes one variable rule to become more favorable to such player, another variable rule changes automatically to become less favorable to such player.

4. A computer readable storage medium according to claim 1, wherein the computer readable storage medium also programs the computer for executing a random-output routine to determine the output of a said turn.

5. A method of playing a game during which a player manages playing pieces in accordance with a set of rules, including a variable rule that is less favorable to the player at least once during the course of the game; and a change-enabling rule that enables the player to change the variable rule upon occurrence of a predetermined condition during the course of the game so that the variable rule becomes more favorable to the player.

6. A method according to claim 5, wherein the variable rule involves execution of a playing turn having an element of chance.

7. A method according to claim 6, wherein the variable rule defines odds for an outcome of a confrontation between the first-recited player and a second player.

8. A method according to claim 5, wherein the variable rule involves wagering.

9. A method according to claim 5, wherein the variable rule involves movement of a playing piece.

10. A method according to claim 5, wherein the variable rule involves acquisition of at least one of the playing pieces.

11. A method according to claim 5, wherein the variable rule involves relative unit values of some of the playing pieces.

12. A computer readable storage medium for use with a computer, wherein the computer readable storage medium programs the computer for controlling a game displayed on a computer monitor during which a player manages displayed playing pieces in accordance with a set of rules, including a variable rule that is less favorable to the player at least once during the course of the game; and a change-enabling rule that enables the player to change the first variable rule upon occurrence of a predetermined condition during the course of the game so that the variable rule becomes: more favorable to the player.

13. A computer readable storage medium according to claim 12, wherein the variable rule involves execution of a playing turn having an element of chance.

14. A computer readable storage medium according to claim 13, wherein the variable rule defines odds for an outcome of a confrontation between the first-recited player and a second player.

15. A computer readable storage medium according to claim 12, wherein the variable rule involves wagering.

16. A computer readable storage medium according to claim 12, wherein the variable rule involves movement of a playing piece.

17. A computer readable storage medium according to claim 12, wherein the variable rule involves acquisition of at least one of the playing pieces.

18. A computer readable storage medium according to claim 12, wherein the variable rule involves relative unit values of some of the playing pieces.

19. A computer readable storage medium according to claim 12 for controlling a game during which a plurality of players manage displayed playing pieces in accordance with a set of rules, including a first variable rule that is more favorable to a first player than to a second player at least once during the course of the game;

a second variable rule that is more favorable to the second player than to some other player when the first variable rule is more favorable to the first player than to the second player and becomes more favorable to said some other player than to the second player whenever the second player changes the first variable rule to become more favorable to the second player; and a change-enabling rule that enables the second player to change the first variable rule upon occurrence of a predetermined condition during the course of the game so that the first variable rule becomes more favorable to the second player.

20. A computer readable storage medium according to claim 12 for controlling a game during which a plurality of players manage displayed playing pieces in accordance with a set of rules, including a first rule involving movement of the playing pieces on a game board; and a second rule for resolving a confrontation that occurs upon movement of a playing piece of a first player to a space on the game board occupied by a playing piece of a second player;

wherein the second rule involves an element of chance for resolving said confrontation; and wherein the computer readable storage medium also programs the computer for executing a random-output routine to determine the output of said confrontation.

* * * * *

UNITED STATES PATENT AND TRADEMARK OFFICE

CERTIFICATE OF CORRECTION

PATENT NO. : 6,481,715 B1
DATED : November 19, 2002
INVENTOR(S) : Edward William Callan It is certified that error appears in the above-identified patent and that said Letters Patent is hereby corrected as shown below:

Column 1,
Lines 42-67, should read: -- The present invention provides a method of playing a game during which a player manages playing pieces in accordance with a set of rules, including a variable rule that is less favorable to the player at least once during the course of the game; and a change-enabling rule that enables the player to change the variable rule upon occurrence of a predetermined condition during the course of the game so that the variable rule becomes more favorable to the player. --

Column 2,
Lines 1-8, should read: -- In another aspect, the present invention provides a computer readable storage medium for use with a computer, wherein the computer readable storage medium programs the computer for controlling a game displayed on a computer monitor during which a player manages displayed playing pieces in accordance with a set of rules, including a variable rule that is less favorable to the player at least once during the course of the game; and a change-enabling rule that enables the player to change the first variable rule upon occurrence of a predetermined condition during the course of the game so that the variable rule becomes more favorable to the player. --

Signed and Sealed this

Eighth Day of July, 2003

JAMES E. ROGAN
*Director of the United States Patent and Trademark Office*